US012636549B1

(12) United States Patent
Hirsch et al.

(10) Patent No.: US 12,636,549 B1
(45) Date of Patent: May 26, 2026

(54) RESERVE ESTIMATES DURING RESISTANCE TRAINING

(71) Applicant: Tonal Systems, Inc., San Francisco, CA (US)

(72) Inventors: Steven Mark Hirsch, Toronto (CA); Joshua Ben Shapiro, Toronto (CA); Lauren Christine Benson, San Francisco, CA (US); Jacob Tyler Rauch, Santa Barbara, CA (US); Giuseppe Barbalinardo, Berkeley, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

(21) Appl. No.: 19/394,008

(22) Filed: Nov. 19, 2025

Related U.S. Application Data

(60) Provisional application No. 63/724,127, filed on Nov. 22, 2024.

(51) Int. Cl.
*A63B 24/00* (2006.01)
*A63B 21/00* (2006.01)
*A63B 21/005* (2006.01)

(52) U.S. Cl.
CPC ..... *A63B 24/0062* (2013.01); *A63B 21/0058* (2013.01); *A63B 21/153* (2013.01); *A63B 2024/0068* (2013.01); *A63B 2024/0093* (2013.01)

(58) Field of Classification Search
CPC ..... A63B 24/0062; A63B 21/0058; A63B 21/153; A63B 2024/0068; A63B 2024/0093
See application file for complete search history.

(56) References Cited

U.S. PATENT DOCUMENTS

| | | | | |
|---|---|---|---|---|
| 5,919,115 | A * | 7/1999 | Horowitz | A63B 21/00181 482/901 |
| 10,335,626 | B2 * | 7/2019 | Orady | A63B 21/0058 |
| 11,452,903 | B2 * | 9/2022 | Watterson | A63B 21/0724 |
| 11,701,546 | B1 * | 7/2023 | Belson | A63B 24/0006 482/8 |
| 2007/0202992 | A1 * | 8/2007 | Grasshoff | A63B 24/00 482/8 |
| 2008/0248926 | A1 * | 10/2008 | Cole | A63B 24/00 482/5 |
| 2010/0069202 | A1 * | 3/2010 | Olsen | A63B 21/0058 482/92 |
| 2010/0216600 | A1 * | 8/2010 | Noffsinger | A63B 23/12 482/5 |
| 2013/0065730 | A1 * | 3/2013 | Camerota | A63B 24/0062 482/5 |
| 2014/0194250 | A1 * | 7/2014 | Reich | A63B 24/0084 482/5 |

(Continued)

*Primary Examiner* — Sundhara M Ganesan
(74) *Attorney, Agent, or Firm* — Van Pelt, Yi & James LLP

(57) ABSTRACT

A time series of raw performance data samples pertaining to performing of a set of repetitions of a movement by a user is collected from a sensor. A set of features is generated from the collected time series of raw performance data samples, including by extracting one or more waveform shape features. The set of features, including the extracted one or more waveform shape features, is provided as input to a model that outputs an estimate of repetitions in reserve.

16 Claims, 8 Drawing Sheets

(56) References Cited

U.S. PATENT DOCUMENTS

| | | | | |
|---|---|---|---|---|
| 2014/0287876 | A1* | 9/2014 | Etter | A63B 24/0087 482/5 |
| 2014/0342878 | A1* | 11/2014 | Hashish | A63B 21/045 482/8 |
| 2017/0361165 | A1* | 12/2017 | Miller | A63B 21/4047 |
| 2021/0394023 | A1* | 12/2021 | Belson | A63B 24/0062 |
| 2022/0323812 | A1* | 10/2022 | O'Connor | A63B 24/0087 |
| 2024/0033571 | A1* | 2/2024 | James | A63B 71/0054 |

* cited by examiner

RESERVE ESTIMATES DURING RESISTANCE TRAINING

CROSS REFERENCE TO OTHER APPLICATIONS

This application claims priority to U.S. Provisional Patent Application No. 63/724,127 entitled IMPROVING RESERVE ESTIMATES DURING RESISTANCE TRAINING filed Nov. 22, 2024 which is incorporated herein by reference for all purposes.

BACKGROUND OF THE INVENTION

Strength training when done safely improves user health. Part of safe strength training is determining when a user is effectively engaged with a repetition of an exercise movement, as this is related to improved muscle development. An improved determination of this provides an improvements in user health, user safety, and makes more efficient use of a user's time and effort.

BRIEF DESCRIPTION OF THE DRAWINGS

Various embodiments of the invention are disclosed in the following detailed description and the accompanying drawings.

DETAILED DESCRIPTION

Figure 1A:
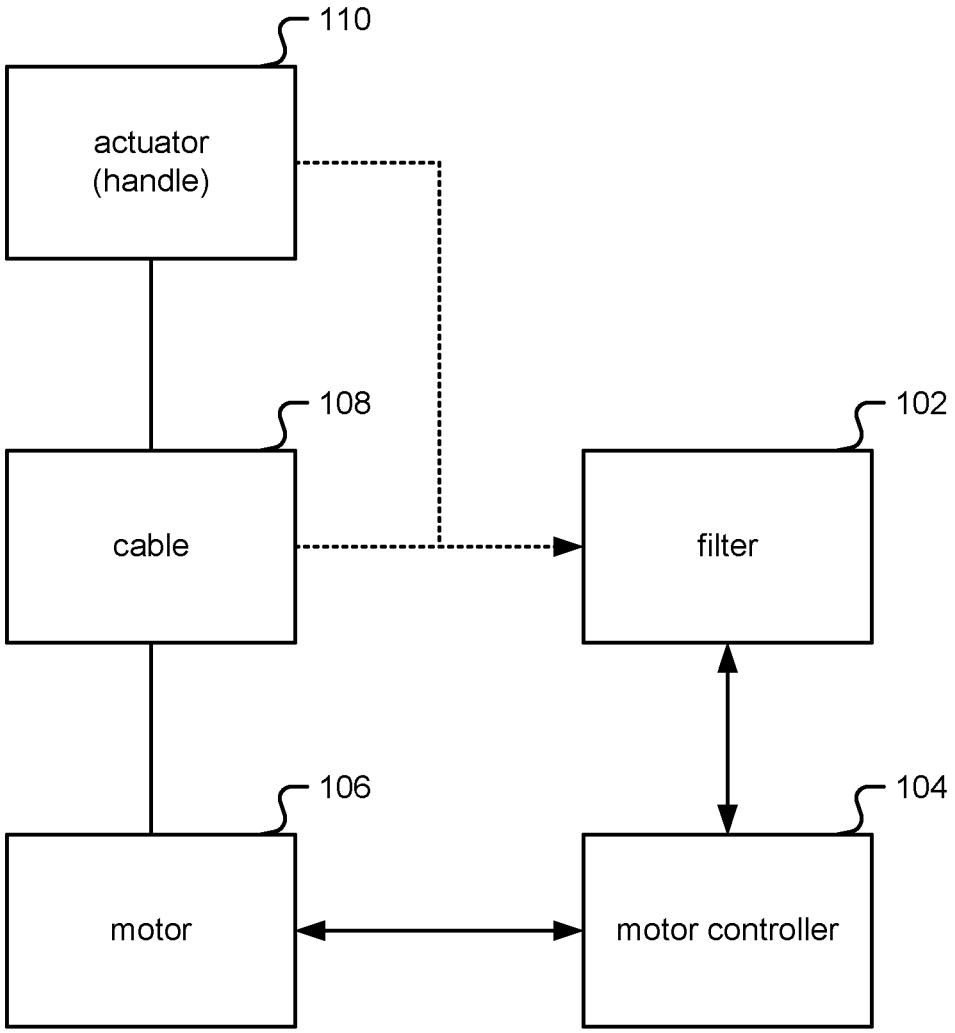
FIG. 1A is a block diagram illustrating an embodiment of an exercise machine capable of digital exercise training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Improving reserve estimates during strength training such as resistance training is disclosed. Typical strength training comprises sets of repetitions ("reps") of a specific movement. As referred to herein, an effective rep refers to reps during training that are effective for eliciting muscular hypertrophy. Reps, such as effective reps, which have high levels of motor unit recruitment alongside high mechanical tension in the muscle fibers stimulate muscular hypertrophy. In strength training, the reps where the trainee is challenged fulfill both criteria, as opposed to initial fresh reps performed in a set, where the user can easily complete reps and therefore does not satisfy the constraint of high levels of motor unit recruitment. As referred to herein, reps in reserve ("RIR") are the repetitions a user may perform before physical failure. Another way to describe an effective rep is a quote from body builder champion Arnold Schwarzenegger: "The last three or four reps is what makes the muscle grow. This area of pain divides the champion from someone else."

As referred to herein, physical failure is when a user demonstrates visibly and/or significantly degraded performance. To illustrate this term physical failure, imagine a hypothetical situation; a user is working out and a human trainer is observing them. The user is absolutely determined to do as many reps as possible, and the trainer wants them to stop only after they have reached their physical limit and their performance is visibly and significantly degraded. The user struggles, even slows at one point, but then seems to have resurgence and does more reps at a faster speed, completely mentally determined to keep going. Eventually their muscles start to give out and they cannot lift the weight up again, their speed and range of motion ("ROM") decreasing substantially. At that point, the trainer recognizes that further attempted reps are pointless because the only way the person can continue is by recruiting other muscles and sacrificing good form. This final point is physical failure and RIR=0. Other variations on this definition are possible, and may fit within the modeling framework described herein.

Visible symptoms of a user reaching physical failure include:

- slowing down during a concentric phase, which may engage a spotter if slow enough;
- speeding up during an eccentric phase, even dropping the actuator such as handles/bar/rope;
- longer rests between reps or very long rests over an overall workout/set. For example, a five second rest or less may be a cutoff assuming they were going faster before;
- range of motion reduction between reps;
- sacrificing form, referred herein as "cheating", to recruit other muscles like twisting the body on a single arm row;

There are prior factors and information that may slightly increase/decrease the probability of failure, which may be detected and/or accommodated:

Sleep length and/or sleep quality;

Muscle fatigue from using the same or similar muscle group earlier in a current workout;

Lack of stability and/or shaking limbs, for example a stabilizer giving out such as a user's core giving out in a goblet squat may cause a "butt tuck" degradation. Another example during a bench press movement is when hands shake; and Cardio and central nervous system ("CNS") fatigue from doing a lot of volume and/or not resting much between sets, even when using different muscle groups.

To be explicit on what physical failure is not, it is not mental failure. For example, it is possible a person ends a set because they think they cannot do another rep or just are not feeling like it, and that is not considered physical failure by the definition herein. The final RIR result should be greater than zero in this case of mental failure. Similarly, maximum relative perceived exertion ("RPE") is not failure, and RPE is not RIR. A user may state that a set was extremely difficult but if they were to actually push themselves to do more reps, it is possible they could have done more before physically failing. Finally, the point where a user traditionally should stop doing reps for an effective and safe workout is not physical failure, and physical failure generally involves more reps to get to RIR=0, beyond what would nominally be safe.

Research has shown that training close to failure is an improvement for maximizing muscle growth (Zourdos et al., 2024, Grgic et al., 2022). Some critical insights of this include:

Training closer to failure is important for muscle growth;

It ramps up recovery time; and

Consistently training to failure may result in compromised technique that increases injury risk.

Therefore, knowing how many repetitions a user has left in reserve before muscular failure is an improvement that allows a user to reach training goals in a safer manner.

In one embodiment, the concept of effective reps is emergent and reps with, for example, five or less repetitions-in-reserve are a threshold for identifying effective reps for eliciting muscular hypertrophy. Without limitation, other thresholds may be used instead of five. In one embodiment, this is an initial threshold for evaluating whether a model can effectively identify effective reps as an alternative measure of monitoring resistance training processes.

Identifying effective reps for maximizing muscular hypertrophy is disclosed. In one embodiment, struggle detection is described in U.S. patent application Ser. No. 17/714,045 entitled EXERCISE MACHINE STRUGGLE DETECTION filed Apr. 5, 2022 which is incorporated herein by reference for all purposes. In one embodiment, struggle detection is based on an aspect—that if people are moving sufficiently "slow" at certain portions of their lift that they will be unable to complete the repetition. For safety reasons, a "spotter mode" on that rep may be used to ensure that users do not actually reach volitional failure. Participants may or may not exercise to a point where they needed a human spotter and supervision to intervene once reaching volitional failure, data was included where "spotter mode" was enabled for all other repetitions in the set, with confidence that a majority of participants did in fact reach failure during their set.

A model may operate at a group level, but some research indicates that individualized models perform better than group models. In one embodiment, individualized models are used more than group-level models. The main advantage of group-level models is that they may be used immediately for all participants without any learning period. However, a hybrid approach is used in some embodiments wherein all users start with a group model for identifying repetitions-in-reserve and after a period of time similar algorithms are deployed that are more specifically tailored to that individual/individualized model.

FIG. 1A is a block diagram illustrating an embodiment of an exercise machine capable of digital exercise training. The exercise machine may include the following, including optional components as not all these elements are necessary:

a controller circuit (104), for example a torque controller (104), which may include a processor, inverter, pulse-width-modulator, and/or a Variable Frequency Drive (VFD);

a motor (106), for example a three-phase AC driven by the controller circuit;

a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. Throughout this specification, a spool may be also referred to as a "hub";

a processor (102), for example a filter (102), to digitally control the controller circuit (104) based on receiving information from the cable (108) and/or actuator (110);

optionally (not shown in FIG. 1) a gearbox between the motor and spool. Gearboxes multiply torque and/or friction, divide speed, and/or split power to multiple spools. Without changing the fundamentals of digital exercise training, a number of combinations of motor and gearbox may be used to achieve the same end result. A cable-pulley system may be used in place of a gearbox, a differential gearbox may be used as a gearbox, and/or a dual motor may be used in place of a gearbox;

one or more of the following sensors (not shown in FIG. 1): a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;

one or more sensors to measure voltage and/or current being consumed by the motor (106), for example to provide inputs to calculate electrical power;

a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase AC motor (106) is used with the following:

- a controller circuit (104)/torque controller (104) combined with processor (102) comprising:
  - a processor that runs software instructions;
  - three pulse width modulators (PWMs), each with two channels, modulated at 20 kHz;
  - six transistors of a three leg inverter coupled to the three PWMs;
  - optionally, two or three ADCs (Analog to Digital Converters) monitoring current through each inverter; and/or
  - optionally, two or three ADCs monitoring inverter phase voltage;
- the three-phase AC motor (106), which may include a synchronous-type and/or asynchronous-type permanent magnet motor, such that:
  - the motor (106) may be in an "out-runner configuration" as described below;
  - the motor (106) may have a maximum torque output of at least 60 Nm and a maximum speed of at least 300 RPMs;
  - optionally, with an encoder or other method to measure motor position;
- a cable (108) wrapped around the body of the motor (106) such that the entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or
- an actuator (110) such as a handle, a bar, a strap, or other accessory connected directly, indirectly, or via a connector such as a carabiner to the cable (108).

In some embodiments, the controller (102)/(104) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine or traditional cable-based aerobic machine like a rower/ergometer, where the cable is attached to a weight stack being acted on by gravity or flywheel. Rather than the user resisting the pull of gravity or flywheel resistance, they are instead resisting the pull of the motor (106).

Taking the example of a strength training device without limitation, note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller (102)/(104) is set to drive the motor (106) with, for example, a constant torque in the direction that spools the cable, corresponding to the same direction as a weight stack being pulled towards the ground, then this translates to a specific force/tension on the cable (108) and actuator (110). Calling this force "Target Tension", this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

AC Motor. While many motors exist that run in thousands of revolutions per second, an application such as a digital exercise device has different requirements and is by comparison a low speed, high torque type application suitable for an AC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

| User Requirements | |
|---|---|
| Target Weight | 200 lbs |
| Target Speed | 62 inches/sec = 1.5748 meters/sec |

-continued

| Requirements by Spool Size | | | | | | |
|---|---|---|---|---|---|---|
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet AC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternatively, a 2:1 gear ratio may be used to accomplish the same thing. Likewise, the diameter of the spool may be adjusted to accomplish the same.

Alternatively, a motor with 100× the speed and 100th the torque may also be used with a 100:1 gearbox. As such a gearbox also multiplies the friction and/or motor inertia by 100×, torque control schemes become challenging to design for exercise applications. Friction may then dominate what a user experiences. In other applications friction may be present, but is low enough that it is compensated for, but when it becomes dominant, it is difficult to control for. For these reasons, direct control of motor speed and/or motor position as with AC motors is more appropriate for exercise devices.

Figure 1B:
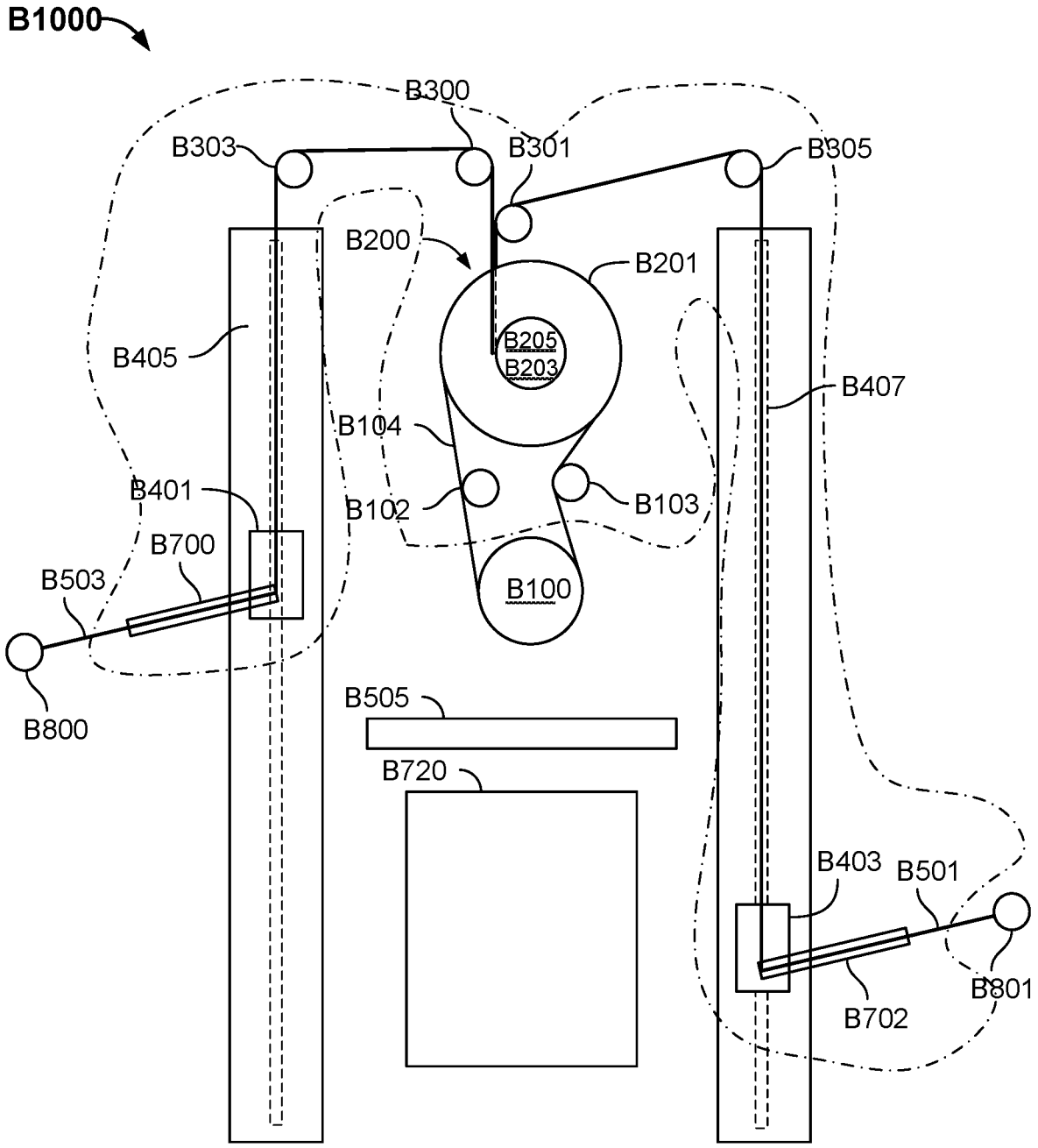
FIG. 1B illustrates a front view of one embodiment of an exercise machine.

FIG. 1B illustrates a front view of one embodiment of an exercise machine. In some embodiments, exercise machine (B1000) of FIG. 1B is an example or alternate view of the exercise machine of FIG. 1A. In this example, exercise machine (B1000) includes a pancake motor (B100), a torque controller coupled to the pancake motor, and a high resolution encoder coupled to the pancake motor (B102). As used herein, a "high resolution" encoder refers to an encoder with an electrical angle resolution of 30 degrees or less. In this example, two cables (B503) and (B501) are coupled respectively to actuators (B800) and (B801) on one end of the cables. The two cables (B503) and (B501) are coupled directly or indirectly on the opposite end to the motor (B100). While an induction motor may be used for motor (B100), a PMSM motor may also be used for its cost, size, weight, and performance. In some embodiments, a high resolution encoder assists the system to determine the position of the PMSM motor to control torque. While an example involving a single motor is shown, the exercise machine may include other configurations of motors, such as dual motors, with each cable coupled to a respective motor.

Sliders (B401) and (B403) may be respectively used to guide the cable (B503) and (B501) respectively along rails (B405) and (B407). The exercise machine in FIG. 1B translates motor torque into cable tension. As a user pulls on actuators (B800) and/or (B801), the machine creates/maintains tension on cable (B503) and/or (B501). The actuators (B800), (B801) and/or cables (B503), (B501) may be actuated in tandem or independently of one another.

In one embodiment, electronics bay (B720) is included and has the necessary electronics to drive the system. In one embodiment, fan tray (B505) is included and has fans that cool the electronics bay (B720) and/or motor (B100).

Drivetrain. As shown in FIG. 1B, the drivetrain is marked by a dash-dot line. As referred to herein, a drivetrain comprises the components that deliver mechanical power between motor (B100) and actuator(s) (B800)/(B801). The drivetrain also comprises the motor itself (B100), the controller (104) in FIG. 1A, and electrical components such as an electrical shunt to dissipate power as heat, and the electrical power supply, typically a wall supply of 120V/240V (not shown in FIG. 1A or 1B). Motor (B100) is coupled by belt (B104) to an optional optical rotary encoder (B102), an optional belt tensioner (B103), and a spool assembly (B200). In one embodiment, an encoder is located in the motor (B100) and element (B102) is not necessary. In one embodiment, the belt tensioner (B103) is not necessary. In one embodiment, motor (B100) is an out-runner, such that the shaft is fixed and the motor body rotates around that shaft. In one embodiment, motor (B100) generates torque in the counter-clockwise direction facing the machine, as in the example in FIG. 1B. Motor (B100) has teeth compatible with the belt integrated into the body of the motor along the outer circumference. Referencing an orientation viewing the front of the system, the left side of the belt (B104) is under tension, while the right side of the belt is slack. The belt tensioner (B103) takes up any slack in the belt. An optical rotary encoder (B102) coupled to the tensioned side of the belt (B104) captures all motor movement, with significant accuracy because of the belt tension. In one embodiment, the optical rotary encoder (B102) is a high resolution encoder. In one embodiment, a toothed belt (B104) is used to reduce belt slip. The spools rotate counter-clockwise as they are spooling cable/taking cable in, and clockwise as they are unspooling/releasing cable out.

Spool assembly (B200) comprises a front spool (B203), rear spool (B205), and belt sprocket (B201). The spool assembly (B200) couples the belt (B104) to the belt sprocket (B201), and couples the two cables (B503) and (B501) respectively with spools (B205) and (B203). Each of these components is part of a low profile design. In one embodiment, a dual motor configuration not shown in FIG. 1B is used to drive each cable (B503) and (B501). In the example shown in FIG. 1B, a single motor (B100) is used as a single source of tension, with a plurality of gears configured as a differential are used to allow the two cables/actuators to be operated independently or in tandem. In one embodiment, spools (B205) and (B203) are directly adjacent to sprocket (B201), thereby minimizing the profile of the machine in FIG. 1B.

As shown in FIG. 1B, two arms (B700), (B702), two cables (B503), (B501) and two spools (B205), (B203) are useful for users with two hands, and the principles disclosed without limitation may be extended to three, four, or more arms (B700) for quadrupeds and/or group exercise. In one embodiment, the plurality of cables (B503), (B501) and spools (B205), (B203) are driven by one sprocket (B201), one belt (B104), and one motor (B100), and so the machine (B1000) combines the pairs of devices associated with each user hand into a single device. In other embodiments, each arm is associated with its own motor and spool. In one embodiment, more than one motor (B100) is coupled to a drivetrain for one or more actuators (B800), for example two motors (B100) each coupled via a drivetrain similar to that shown in FIG. 1B to a single actuator (B800).

In one embodiment, motor (B100) provides constant tension on cables (B503) and (B501) despite the fact that each of cables (B503) and (B501) may move at different speeds. For example, some physical exercises may require use of only one cable at a time. For another example, a user may be stronger on one side of their body than another side, causing differential speed of movement between cables (B503) and (B501). In one embodiment, a device combining dual cables (B503) and (B501) for a single belt (B104) and sprocket (B201) retains a low profile, in order to maintain the compact nature of the machine, which can be mounted on a wall.

In one embodiment, pancake style motor(s) (B100), sprocket(s) (B201), and spools (B205, 203) are manufactured and arranged in such a way that they physically fit together within the same space, thereby maximizing functionality while maintaining a low profile.

As shown in FIG. 1B, spools (B205) and (B203) are respectively coupled to cables (B503) and (B501) that are wrapped around the spools. The cables (B503) and (B501) route through the system to actuators (B800) and (B801), respectively.

The cables (B503) and (B501) are respectively positioned in part by the use of "arms" (B700) and (B702). The arms (B700) and (B702) provide a framework for which pulleys and/or pivot points may be positioned. The base of arm (B700) is at arm slider (B401) and the base of arm (B702) is at arm slider (B403).

The cable (B503) for a left arm (B700) is attached at one end to actuator (B800). The cable routes via arm slider (B401) where it engages a pulley as it changes direction, then routes along the axis of rotation of track (B405). At the top of rail/track (B405), fixed to the frame rather than the track, is pulley (B303) that orients the cable in the direction of pulley (B300), that further orients the cable (B503) in the direction of spool (B205), wherein the cable (B503) is wound around spool (B205) and attached to spool (B205) at the other end.

Similarly, the cable (B501) for a right arm (B702) is attached at one end to actuator (B801). The cable (B501) routes via slider (B403) where it engages a pulley as it changes direction, then routes along the axis of rotation of rail/track (B407). At the top of the rail/track (B407), fixed to the frame rather than the track is pulley (B305) that orients the cable in the direction of pulley (B301), that further orients the cable in the direction of spool (B203), wherein the cable (B501) is wound around spool (B203) and attached to spool (B203) at the other end.

One use of pulleys (B300), (B301) is that they permit the respective cables (B503), (B501) to engage respective spools (B205), (B203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

In the example shown in FIG. 1B, pulley (B301) is lower than pulley (B300). This demonstrates the flexibility of routing cables. In one embodiment, mounting pulley (B301) leaves clearance for certain design aesthetic elements that make the machine appear to be thinner.

In one embodiment, the exercise machine/appliance passes a load/resistance against the user via one or more lines/cables, to a grip(s) (examples of an actuator) that a user displaces to exercise. A grip may be positioned relative to the user using a load arm and the load path to the user may be steered using pulleys at the load arm ends, as described above. The load arm may be connected to a frame of the exercise machine using a carriage that moves within a track that may be affixed to the main part of the frame. In one embodiment, the frame is firmly attached to a rigid structure such as a wall. In some embodiments, the frame is not mounted directly to the wall. Instead, a wall bracket is first mounted to the wall, and the frame is attached to the wall bracket. In other embodiments, the exercise machine is mounted to the floor. The exercise machine may be mounted to both the floor and the wall for increased stability. In other embodiments, the exercise machine is a freestanding device.

In some embodiments, the exercise machine includes a media controller and/or processor, which monitors/measures user performance (for example, using the one or more sensors described above), and determines loads to be applied to the user's efforts in the resistance unit (e.g., motor described above). Without limitation, the media controller and processor may be separate control units or combined in a single package. In some embodiments, the controller is further coupled to a display/acoustic channel that allows instructional information to be presented to a user and with which the user interacts in a visual manner, which includes communication based on the eye such as video and/or text or icons, and/or an auditory manner, which includes communication based on the ear such as verbal speech, text-tospeech synthesis, and/or music. Collocated with an information channel is a data channel that passes control program information to the processor which generates, for example, exercise loading schedules. In some embodiments, the display is embedded or incorporated into the exercise machine, but need not be (e.g., the display or screen may be separate from the exercise machine, and may be part of a separate device such as a smartphone, tablet, laptop, etc. that may be communicatively coupled (e.g., either in a wired or wireless manner) to the exercise machine). In one embodiment, the display is a large format, surround screen representing a virtual reality/alternate reality environment to the user; a virtual reality and/or alternate reality presentation may also be made using a headset. The display may be oriented in landscape or portrait.

In one embodiment, the appliance media controller provides audio information that is related to the visual information from a program store/repository that may be coupled to external devices or transducers to provide the user with an auditory experience that matches the visual experience. Control instructions that set the operational parameters of the resistance unit for controlling the load or resistance for the user may be embedded with the user information so that the media package includes information usable by the controller to run the machine. In this way a user may choose an exercise regime and may be provided with cues, visual and auditory as appropriate, that allow, for example, the actions of a personal trainer to be emulated. The controller may further emulate the actions of a trainer using an expert system and thus exhibit artificial intelligence. The user may better form a relationship with the emulated coach or trainer, and this relationship may be encouraged by using emotional/mood cues whose effect may be quantified based on performance metrics gleaned from exercise records that track user performance in a feedback loop using, for example, the sensor(s) described above.

Figure 1C:
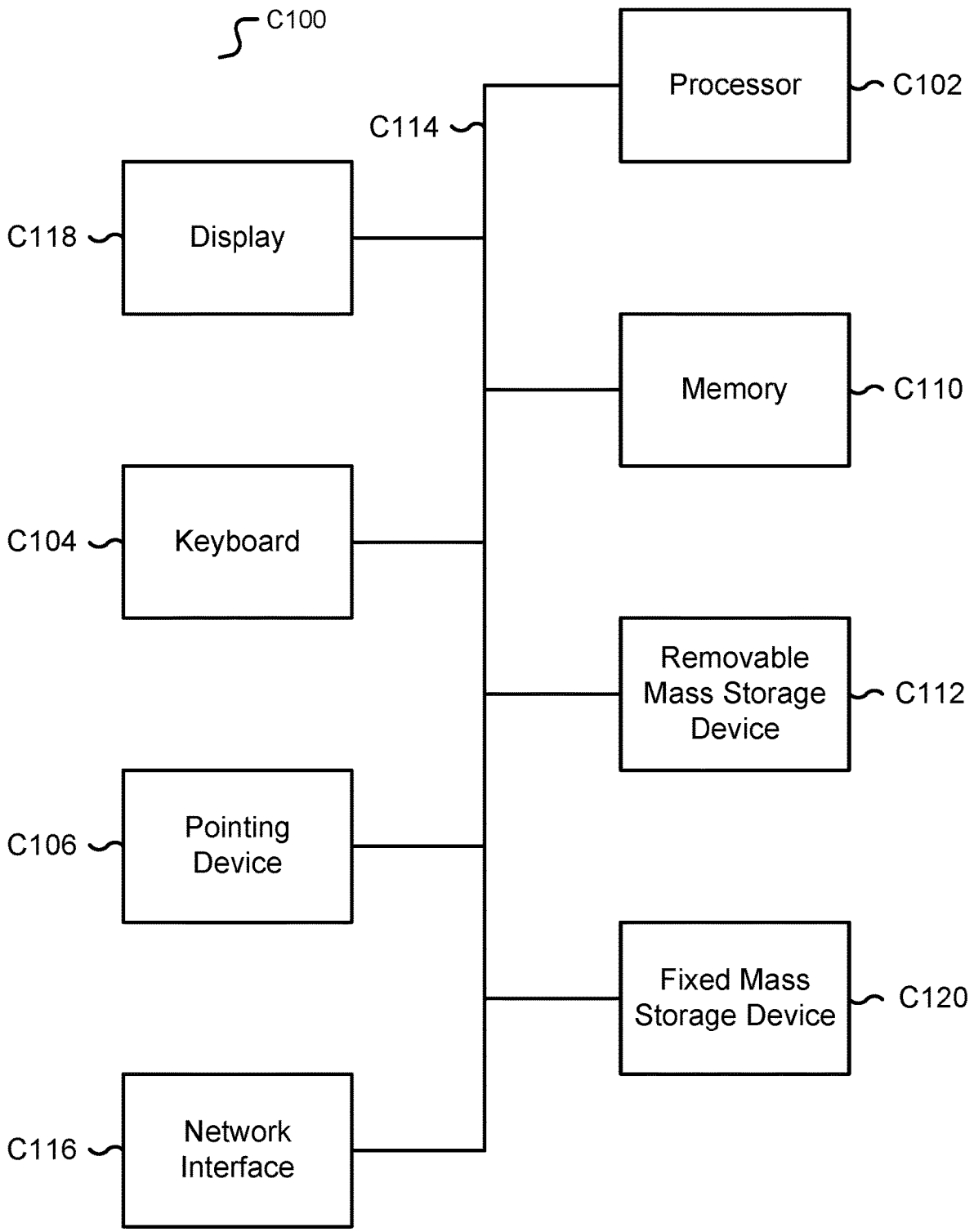
FIG. 1C is a functional diagram illustrating a programmed computer/server system for facilitating RIR estimation in accordance with some embodiments.

Processor in Exercise Machine. FIG. 1C is a functional diagram illustrating a programmed computer/server system for facilitating RIR estimation in accordance with some embodiments. As shown, FIG. 1 provides a functional diagram of a general-purpose computer system programmed to facilitate RIR estimation in accordance with some embodiments. As will be apparent, other computer system architectures and configurations can be used for facilitating RIR estimation. In one embodiment, the system (C100) of FIG. 1C is part of the filter (102) and/or motor controller (104) of FIG. 1A, and may be placed in bay (B720) of FIG. 1B. In one embodiment, the system (C100) of FIG. 1C is partially or fully remote to the system shown in FIG. 1A and/or FIG. 1B, and coupled by a network to a receiver in the system shown in FIG. 1A and/or FIG. 1B to provide processing functionality.

Computer system (C100), which includes various subsystems as described below, includes at least one microprocessor subsystem, also referred to as a processor or a central processing unit ("CPU") (C102). For example, processor (C102) can be implemented by a single-chip processor or by multiple cores and/or processors. In some embodiments, processor (C102) is a general purpose digital processor that controls the operation of the computer system (C100). Using instructions retrieved from memory (C110), the processor (C102) controls the reception and manipulation of input data, and the output and display of data on output devices, for example display and graphics processing unit (GPU) (C118).

Processor (C102) is coupled bi-directionally with memory (C110), which can include a first primary storage, typically a random-access memory ("RAM"), and a second primary storage area, typically a read-only memory ("ROM"). As is well known in the art, primary storage can be used as a general storage area and as scratch-pad memory, and can also be used to store input data and processed data. Primary storage can also store programming instructions and data, in the form of data objects and text objects, in addition to other data and instructions for processes operating on processor (C102). Also as well known in the art, primary storage typically includes basic operating instructions, program code, data, and objects used by the processor (C102) to perform its functions, for example, programmed instructions. For example, primary storage devices (C110) can include any suitable computer-readable storage media, described below, depending on whether, for example, data access needs to be bi-directional or uni-directional. For example, processor (C102) can also directly and very rapidly retrieve and store frequently needed data in a cache memory, not shown. The processor (C102) may also include a coprocessor (not shown) as a supplemental processing component to aid the processor and/or memory (C110).

A removable mass storage device (C112) provides additional data storage capacity for the computer system (C100), and is coupled either bi-directionally (read/write) or uni-directionally (read-only) to processor(s) (C102). For example, storage (C112) can also include computer-readable media such as flash memory, portable mass storage devices, holographic storage devices, magnetic devices, magneto-optical devices, optical devices, and other storage devices. A fixed mass storage (C120) can also, for example, provide additional data storage capacity. One example of mass storage (C120) is an eMMC or microSD device. In one embodiment, mass storage (C120) is a solid-state drive connected by a bus (C114). Mass storages (C112), (C120) generally store additional programming instructions, data, and the like that typically are not in active use by the processor (C102). It will be appreciated that the information retained within mass storages (C112), (C120) can be incorporated, if needed, in standard fashion as part of primary storage (C110), for example RAM, as virtual memory.

In addition to providing processor (C102) access to storage subsystems, bus (C114) can be used to provide access to other subsystems and devices as well. As shown, these can include a display monitor (C118), a communication interface (C116), a touch (or physical) keyboard (C104), and one or more auxiliary input/output devices (C106) including an audio interface, a sound card, microphone, audio port, audio input device, audio card, speakers, a touch (or pointing) device, and/or other subsystems as needed. Besides a touch screen, the auxiliary device (C106) can be a mouse, stylus, track ball, or tablet, and is useful for interacting with a graphical user interface. The display monitor (C118) may be on the exercise machine shown in FIG. 1A and/or FIG. 1B, or a display monitor (C118) may be on a mobile device coupled via network to the system shown in FIG. 1A, FIG. 1B, and/or FIG. 1C. In one embodiment, the keyboard (C104) and/or pointing device (C106) is a device such as a mini pointer on part of the system shown as an actuator (110) in FIG. 1A and/or (B800)/(B801) in FIG. 1B, or a mobile device coupled via network to the system shown in FIG. 1A, FIG. 1B, and/or FIG. 1C.

The communication interface (C116) allows processor (C102) to be coupled to another computer, computer network, or telecommunications network using a network connection as shown. For example, through the communication interface (C116), the processor (C102) can receive information, for example data objects or program instructions, from another network, or output information to another network in the course of performing method/process steps. Information, often represented as a sequence of instructions to be executed on a processor, can be received from and output to another network. An interface card or similar device and appropriate software implemented by, for example executed/performed on, processor (C102) can be used to connect the computer system (C100) to an external network and transfer data according to standard protocols. For example, various process embodiments disclosed herein can be executed on processor (C102), or can be performed across a network such as the Internet, intranet networks, or local area networks, in conjunction with a remote processor that shares a portion of the processing. Throughout this specification, "network" refers to any interconnection between computer components including the Internet, Bluetooth, WiFi, 3G, 4G, 4GLTE, GSM, Ethernet, intranet, local-area network ("LAN"), home-area network ("HAN"), serial connection, parallel connection, wide-area network ("WAN"), Fibre Channel, PCI/PCI-X, AGP, VLbus, PCI Express, Expresscard, Infiniband, ACCESS.bus, Wireless LAN, HomePNA, Optical Fibre, G.hn, infrared network, satellite network, microwave network, cellular network, virtual private network ("VPN"), Universal Serial Bus ("USB"), FireWire, Serial ATA, 1-Wire, UNI/O, or any form of connecting homogenous and/or heterogeneous systems and/or groups of systems together. Additional mass storage devices, not shown, can also be connected to processor (C102) through communication interface (C116).

An auxiliary I/O device interface, not shown, can be used in conjunction with computer system (C100). The auxiliary I/O device interface can include general and customized interfaces that allow the processor (C102) to send and, more typically, receive data from other devices such as microphones, touch-sensitive displays, transducer card readers, tape readers, voice or handwriting recognizers, biometrics readers, cameras, portable mass storage devices, and other computers.

In addition, various embodiments disclosed herein further relate to computer storage products with a computer readable medium that includes program code for performing various computer-implemented operations. The computer-readable medium is any data storage device that can store data which can thereafter be read by a computer system. Examples of computer-readable media include, but are not limited to, all the media mentioned above: flash media such as NAND flash, eMMC, SD, compact flash; magnetic media such as hard disks, floppy disks, and magnetic tape; optical media such as CD-ROM disks; magneto-optical media such as optical disks; and specially configured hardware devices such as application-specific integrated circuits ("ASIC"s), programmable logic devices ("PLD" s), and ROM and RAM devices. Examples of program code include both machine code, as produced, for example, by a compiler, or files containing higher level code, for example a script, that can be executed using an interpreter.

The computer/server system shown in FIG. 1 is but an example of a computer system suitable for use with the various embodiments disclosed herein. Other computer systems suitable for such use can include additional or fewer subsystems. In addition, bus (C114) is illustrative of any interconnection scheme serving to link the subsystems. Other computer architectures having different configurations of subsystems can also be utilized.

Figure 2:
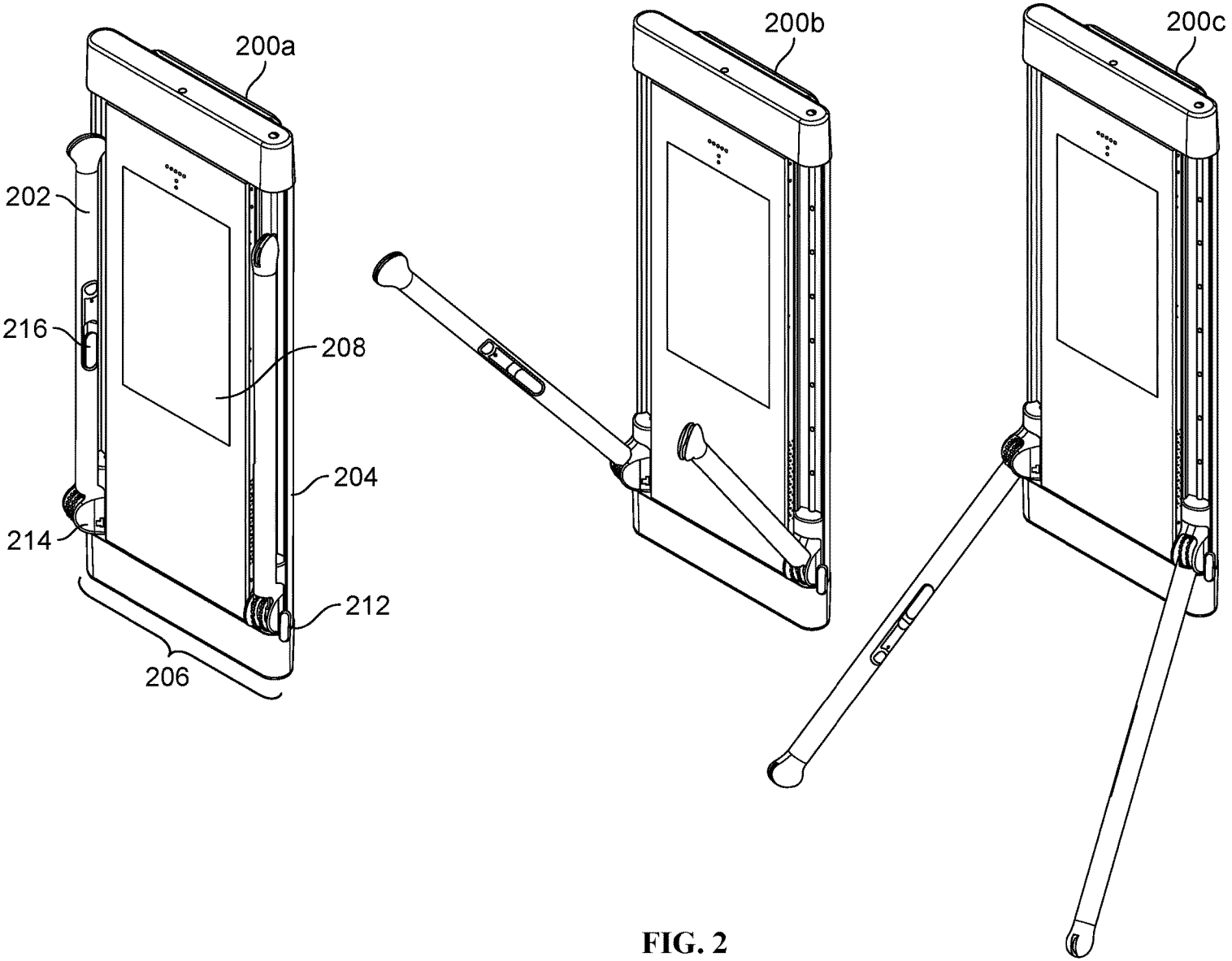
FIG. 2 includes front perspective views of an embodiment of a weight training machine.

Multi-Motor and/or Multi-Spool Based Embodiments. FIG. 2 includes front perspective views of an embodiment of a weight training machine. In one embodiment, the machine of FIG. 2 is the exercise device represented in a block diagram in FIG. 1. In the example of FIG. 2, the exercise device has two arms.

FIG. 2 illustrates an exercise machine with the arms (202) and (204) in a stowed position, where the arms are upright in stowed position (200*a*). FIG. 2 also shows two other positions: first where the exercise machine with the arms vertically pivoted outwards, or angled away from the body of the exercise machine, pointing in an upwards direction (200*b*), and second where the arms are in mid-vertical pivot, pointing in a downwards direction (200*c*).

In this example, control (216) includes controls for unlocking the adjustment of the position of arm (202). In one embodiment, arm (204) also includes a corresponding set of controls. The arms may be independently pivoted to any angle as appropriate.

The exercise machine of FIG. 2 is an embodiment of a digital exercise device/trainer that may use one or two motors as load elements to provide electronic resistance. In the case of a single motor, a differential gearbox may be used. One or two spools may be used with the one or two motors.

In one embodiment, cables travel within the arms, where one end of a cable in a given arm is coupled or otherwise connected to a motor, which may be in the body of the exercise machine. In one embodiment, at the distal end of an arm, away from the body/central console (206) of the trainer, is a handle attached to one end of the cable. A handle is but one example of an actuator that may be used by a user to perform exercise.

In one embodiment, the exercise machine is mounted to a wall. In one embodiment, the exercise machine is floor mounted. The exercise machine may also be a combination of wall/floor mounted. For example, the exercise machine may be mounted to the wall as well as bolted to the floor. The exercise machine may also stand on the floor while being wall mounted. In one embodiment, the exercise machine is freestanding. For example, the exercise machine is attached to a moveable stand, where the stand need not be hard mounted.

In one embodiment, the exercise machine includes one or more of: an antenna, a camera, other optical sensors, depth sensors, infrared sensors, a display, a touch screen, a touch screen controller, an audio input device, a microphone, an audio output device, a speaker, a motor controller, one or more electric motors, one or more spools, one or more cables, and actuators such as handles. The body (206) may include a screen (208).

The motor controller, the handles, and the electric motor are exemplary controllers, exercising components/actuators, and resistive devices/load elements, respectively. In one embodiment, the exercise machine includes multiple motors, for example one per arm. The machine shown in FIG. 2 may have two motors/spools, where an embodiment of a four arm exercise machine (not shown) may have four motors/spools.

In one embodiment, the exercise machine includes a central console (206) for controlling the exercise machine. The console may include a display (208). In one embodiment, the display is a touch screen. In such an example, the display allows instructional information such as virtual training content to be presented to the user and with which a user interacts. In one embodiment, to reduce the interference with an exercise routine that occurs whenever a user interacts with the exercise appliance/machine features or controls, controls are incorporated in the handle. For example, this is an improvement from a case where the user has to release one of the handles in order to use that hand to modify settings selected from options indicated at the display (208) or physical controls located at the control panel (206). Thus, by suitable location of the user controls and application of control context information, the user is able to alter the exercise machine settings with better efficiency to the exercise regime and/or better user safety.

In one embodiment, the exercise machine does not have a display and may be connected to a television or touch-screen monitor via a connection such as HDMI, USB, HDCP, and/or Displayport. In one embodiment, images, video, streaming, audiovisual content, and/or multimedia are transmitted wirelessly to an external display device or other receiver devices such as virtual reality sets, augmented reality sets, set top boxes, and/or game consoles. In one embodiment, data is sent to an application on a mobile device such as a tablet or smartphone, where the application then interprets and renders a user interface for interacting with the exercise machine and/or viewing exercise data measured by the exercise machine for example.

The arms of the exercise machine may have various degrees of freedom (DOFs). In the examples of FIG. 2, the arms of the exercise machine are each capable of moving in at least two directions: 1) horizontal pivot; and 2) vertical pivot (a rotation of the arm relative to the ground). As shown in the example of FIG. 2, the arms pivot vertically about points (212) and (214), which are also referred to herein as the "shoulders" of the exercise machine. In one embodiment, the arms of the exercise machine are each capable of moving in a third direction: translation such as sliding vertically up and down a track.

In one embodiment, the arms of the exercise machine may each have one, two, or three degrees of freedom: 1) vertical pivot, also referred to herein as arm vertical pivoting in the "sagittal" plane, 2) horizontal pivot, to rotate around the shoulder, and/or 3) telescoping of the arm, such as retraction/collapsing of the arm and extension of the arm.

In one embodiment, the arms of the exercise machine are angled outwards from the body (206) of the machine. For example, the arms (202, 204) are not, when extended, perpendicular to the body (206), but rather are slanted horizontally outwards. In one embodiment, angled arms are used in lieu of having an additional degree of freedom, for example, horizontal pivot of the arms, so the arms (202, 204) have two degrees of freedom with vertical pivot and telescoping.

By having the arms on a horizontal pivot angle, when the arms pivot, they start when pointed upward in their most compact/least wide configuration, and widen as they move downwards. This allows the distance between the arms to vary based on the pivot angle. The telescoping, along with the vertical pivot and angled out arms, allows for the arms to provide a large range of motion. The use of angled arms provides various benefits, for example, by simplifying the design of the arms and reducing complexity and cost, such as by removing the need to have mechanisms to allow the arms to pivot horizontally, but still retaining a similar amount of functionality as would be provided by implementing horizontal pivoting of the arms.

Floor-Based Embodiments. In one embodiment, the machine described in FIG. 1 includes ones wherein components such as motors are placed lower, such as near to or on the ground. Floor-based machines described herein have various benefits and/or improvements. For example, a floor-based configuration may be designed to not require arms (202, 204) that have degrees of freedom. The degrees of freedom of arms may be expensive, for example because the arms not only need to pass loads through them, but also be lockable and adjustable. Furthermore, the use of arms may necessitate wall mounting of an exercise machine, which may introduce further installation cost and complexity. Thus, the removal or non-use of such degrees of freedom may allow for less expensive and complex exercise machines while still providing a useful exercise regime.

In one embodiment, floor-based machines are used in conjunction with auxiliary pulleys and/or other cable ends, so that users of the exercise machines and/or weight trainers are configured to pull down on a cable coupled to a cable, for example, retracting cables downward toward the floor. This may mimic the action of weights pulling downwards. In one embodiment, the user stands on the exercise machine. In one embodiment, the user sits on the exercise machine.

One example of a floor-based configuration of a weight machine is a platform or step. A platform configuration of a digital exercise device/trainer has various benefits and/or improvements. For example, it may be portable since it need not be mounted. This allows the exercise machine to be stored away efficiently and/or safely.

Exercise Device Powertrain/Drivetrain. As shown in FIG. 1B, the drivetrain comprises parts (B103), (B104), (B200), (B201), (B203), (B205), (B300)/(B301), (B303)/(B305), (B401)/(B403), and (B501)/(B503). The drivetrain also comprises the motor (B100) The drivetrain does work on the user in order to extract energy from them, wherein the user may be seen as an energy reservoir. The physical relationship that $$\text{Power}=\text{Force}\times\text{Velocity}$$

describes that if the actuator velocity/speed and/or cable velocity/speed increases, power of the motor (B100) and drivetrain increases as well since force, or the simulated weight, is held constant. Similarly, as torque and rotational speed are related to force and velocity, $$\text{Torque} = \frac{1}{2\pi}\frac{\text{Power}}{\text{Rotational Speed}}$$

wherein rotational speed is based upon supply voltage of the motor (B100) and torque generated is related to phase current of the motor (B100).

Two motor constants may be used to describe characteristics of the one or more drivetrain motors (B100). The torque constant or $K_t$ as referred to herein relates the phase current of a motor and generated torque such that $$K_t = \frac{\text{Torque}}{\text{PhaseCurrent}}$$

and the back EMF constant or $K_e$ as referred to herein relates the back EMF generated by the motors (B100) and their rotational speed such that $$K_e = \frac{\text{Back } EMF \text{ Generated}}{\text{Rotational Speed}}$$

For a given motor (B100), gearing allows an exchange of rotational speed for torque, wherein the gearing may come from a gearbox, spool diameter, and/or belt drive reduction, for example. Gearboxes and spools may have user experience and inertia impacts but result in a more efficient system, and geared motors may be smaller for the same torque when compared to a direct drive motor.

The drivetrain operations in at least three modes: a motoring mode wherein electrical power sent from an electrical power supply unit (PSU) to the motor so that the motor does mechanical work on the user; a generator mode wherein the user does mechanical work on the motor and the user's power is dissipated and/or reused within the drivetrain and/or motor; and a shared power mode when the user input power is less than the motor losses, as summarized in Table 1:

Drivetrain Components used in each Mode

| User Direction | Mode | Motor | Controller | Shunt | Power Supply Unit |
|---|---|---|---|---|---|
| Eccentric | Motoring | Yes | Yes | No | Yes |
| Concentric | Generator | Yes | Yes | Yes | No |
| | Shared Power | Yes | Yes | No | Yes |

Predicting Reps in Reserve (RIR) with Machine Learning. Estimating RIR accurately, for a broad set of users, for a diverse set of users, using high-frequency sensor data, concise biomechanics, and/or machine learning is disclosed. An improvement over traditional approaches is a model that is at least doubly more effective, and improves safety and effectiveness for a given user with the disclosed. Estimating RIR is challenging because it is noisy; people vary in their effort, pacing, movement strategies, and their level of coaching or external encouragement. Traditional RIR models may use a simplistic approach: predict RIR based on the drop in concentric velocity across a set, since they may assume a monotonic decrease in velocity. But this method is challenging because users may not exert maximal effort, or may have velocity patterns which are not smooth or linear.

Figure 3:
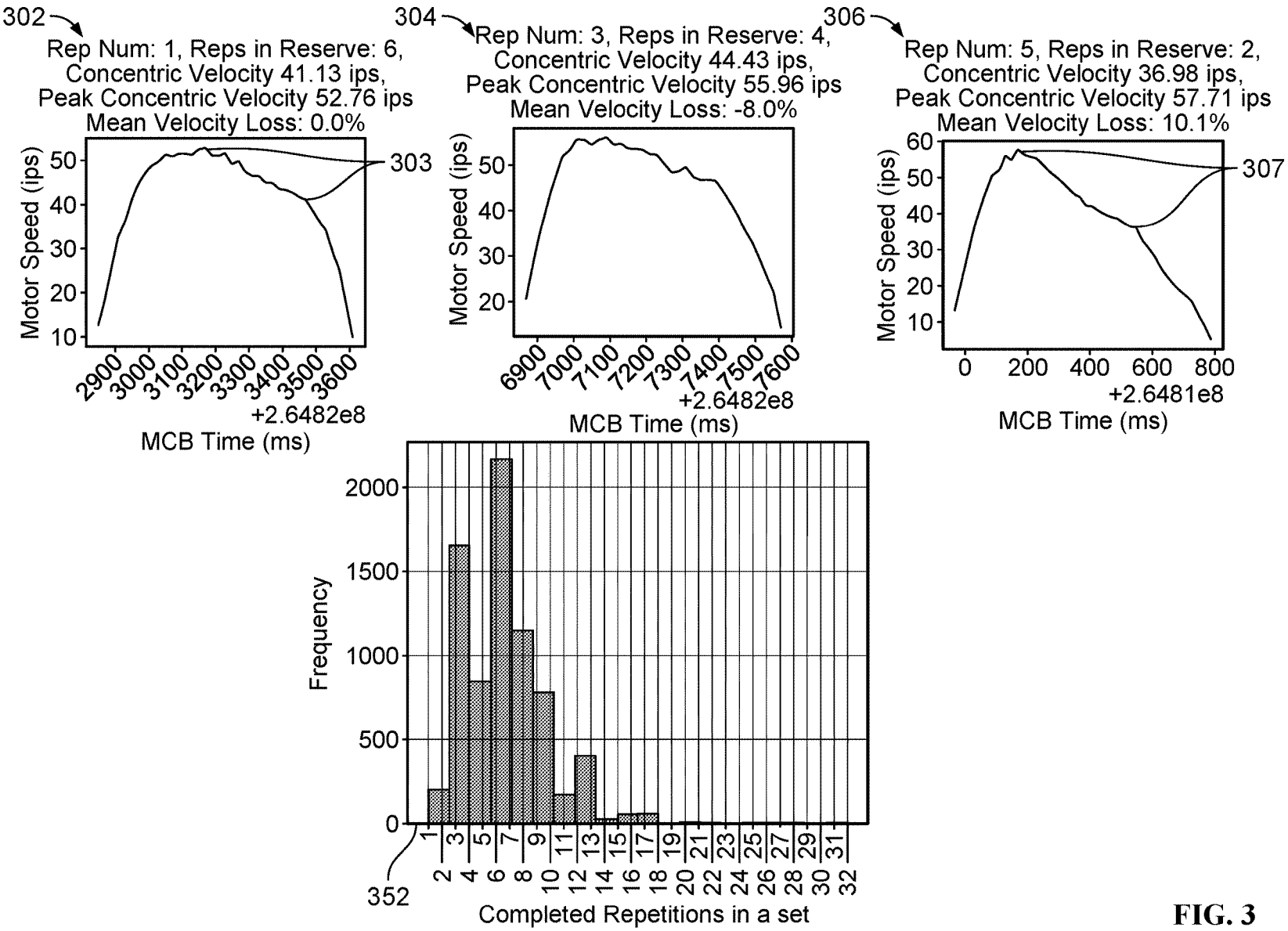
FIG. 3 is an illustration of sample data from recording anonymous users.

FIG. 3 is an illustration of sample data from recording anonymous users. In one embodiment, the data rendered in FIG. 3 is recorded from machines such as those in FIG. 2.

The data in graphs (302), (304), and (306) represent the first, third, and fifth rep respectively of a trainee's bench press. The x-axis represents time and the y-axis represents their velocity in each of the three graphs.

As shown in graphs (302), (304), and (306) there is not consistent velocity loss after each rep as assumed in traditional models. For example, rep 3 in graph (304) has a faster average velocity than rep 1 in graph (302). Thus what is already a challenging task in traditional laboratory models is made even more difficult by the realities of how people move in the real world.

As shown in graphs (302), (304), and (306), summarizing the waveforms with a single number such as average velocity is simplistic and may not provide appropriate correlation. By contrast, the observation that for many users a higher rate of decline in the mid-range portion of concentric velocity waveform, for example between (303) for rep 1 and (307) for rep 5, is more positively correlated with more fatigue. Put another way, many users' velocity in this mid-range of the rep stays flat as shown in (303), but typically begins to decline more rapidly as shown in (307) when they start to get more fatigued. This example is particularly informed as the average velocity increases from rep 1 (302) to rep 5 (306) which simplistically might contraindicate fatigue in a traditional model, but the richer waveform/time-series analysis indicates fatigue in the advanced model.

In one embodiment, reps are used from anonymous users to build and evaluate a model. For example, 56,025 bench press reps from 4,482 anonymous users were used in part by sampling position and velocity data at 50 hz during regular training sessions. In one embodiment, to ensure high data quality, sets and data are filtered based on the following conditions:

- Only users with ≥50 completed bench press sets were included to build the model;
- In the filtered sets, a spotter mode was used, wherein the spotter mode was triggered by a user struggling. For example, a spotter mode may be triggered on when a user fails to lift the barbell at least 0.06m within 500 ms (i.e., less than 0.12 m/s), along with some additional logic to ensure that participants reached volitional failure, and thus when it is clear a user may not complete the repetition anymore, wherein the digital weight is lowered so that the person is still safe;
- In the filtered sets, once spotter is engaged, in the retained sets the user continued to require the spotter mode for every rep thereafter, to eliminate users who needed a temporary bit of help but who did not actually hit failure;
- In the filtered sets, the load a person was lifting was within 20% of the trainer's prescribed weight, to eliminate users who lifted a load much higher or lower than what was expected after already calibrating to their strength with at least 50 sets of bench presses; and/or
- In the filtered sets, at least half of the prescribed set were completed without spotter assistance, to eliminate sets where the load selected for the user was out of the ordinary.

In graph (352) a histogram of the number of reps users performed per set before failing is rendered. As shown in FIG. 3 (352), the x-axis represents the number of completed reps in a set, and the y-axis represents the frequency with which a given number of completed reps in a set is accomplished in the dataset of 56,025 bench press reps. Using the rep-level data shown in FIG. 3 (352), the model was configured to predict based on data from a single rep, how many more reps the user may perform before failure, with the 56,025 bench press reps shown in FIG. 3 (352) as training for the model.

Unlike traditional models using mean velocity loss during a set to estimate RIR, the disclosed model uses richer feature engineering for prediction to assist the model detect subtle cues of fatigue and struggle not captured by velocity loss alone to provide a more accurate RIR estimate. In one embodiment, data pre-processing is used to digest and/or prepare features from performance information. The model may comprise features from at least one of the following:

- Waveform shape features: Using principal component analysis (PCA) on normalized curves such as normalized velocity curves, waveform shape features are extracted. This in part captures changes in waveforms such as velocity waveforms that occur independently of the velocity attained, which may be representative of fatigue levels, and thus RIR. Put another way, a waveform is a time series data for a given rep of a metric such as position, velocity, and/or acceleration, and an analysis such as PCA is used to capture different waveform shapes such as different waveform components and/or moments like variance, skewness, and/or kurtosis. Without limitation, other waveform analysis may be used including and/or besides PCA, for example a temporal convolutional network;

Rate of force development (RFD): Rate of force development is a metric that captures how quickly a trainee develops force. Significant RFD metrics including peak force, timing, and intervals up to a threshold, for example 400 ms. In one embodiment, kinetic data provides information about the force-producing capacity that a person still has. This is still impacted by how much effort someone is putting forth, and people may maintain a higher RFD earlier in a set when they are less fatigued even when coasting through the rest of the repetition. Put another way, RFD is informative for capturing fatigue and intent to see if a given user is coasting at all during a lift, or if they are actually fatiguing when the metric declines;

Speed and force ratios between concentric and eccentric phases: Additional information about how people are controlling the actuator/dumbbell/barbell on the way down, that is during the eccentric phase, may be informative of their general fatigue levels; and/or Set-level context: Prescribed reps/the percentage of their one repetition maximum load (i.e., % 1 RM) they were lifting. Additional metadata may give the sets, and the reps within those sets, more context, such as the experience level of the user, their muscle readiness going into the workout, the proportion of the prescribed load that is from proprietary weight modes such as chains, eccentric, or smartflex.

Without limitations, other features may be used, for example biomechanical data such as heart rate, and/or face or hand key points that indicate a user's grimace, joint motion, and/or joint motion over time.

In one embodiment, the model may leverage these richer features based at least on one set of performance information, for example the last rep. In one embodiment, the model may also assess a plurality of sets of performance information, for example the second last rep or a historical set of recent reps, for example all of a current day's reps in a user's given workout. Thus, sequencing information of the user's recent reps provides a deeper feature set that involves the above features and cross-correlation between the above features over the sequence and/or time.

Model Architecture. In addition to richer feature engineering, rather than using a traditional linear regression model based on velocity loss, an advanced model architecture is used, such as a gradient boosted tree, an example of which is LightGBM. To evaluate the accuracy of the disclosed advanced model architecture, it is compared against traditional Velocity Loss and Prescribed Reps models using two measures: the overall mean absolute error (MAE) across all reps in a given dataset, as well as the MAE when trainees are at 5 or fewer RIR.

In one embodiment, ≤5 RIR is motivated by two things: most RIR models perform better the closer someone is to failure; and efficient identification of effective reps. That is, successful identification of effective reps brings an improvement of greater insight into both how close a user is to failure as well as having a measure of how effective their overall workout is. By counting the number of effective reps a user accrues during training, it can be evaluated if they are making good progress towards their muscle growth goals, as people with muscle growth goals would accumulate many reps close to failure. While this metric may sacrifice some resolution for use-cases such as predicting when someone is going to fail, it may be effective enough for identifying training stimuli for monitoring progress and understanding how much time someone may need to recover from their workout. To assess the accuracy of each model's ability to identify effective reps, the precision, recall, and F1 score of each model was computed as well. Comparing each model using the same training data, and the same holdout test set (that is, a dataset that was not used to train the models to assess their generalization accuracy) gives the results in Table 2:

TABLE 2

Reps in Reserve Model Performance.

| Model | MAE (Total) | MAE (RIR ≤ 5) | Precision | Recall | F1 |
|---|---|---|---|---|---|
| Velocity Loss | 2.31 | 1.44 | 0.78 | 0.99 | 0.87 |
| Prescribed Reps | 1.51 | 1.27 | 0.93 | 0.91 | 0.92 |
| Advanced Architecture | 1.12 | 0.73 | 0.94 | 0.89 | 0.92 |

As shown in Table 2, the advanced architecture model outperformed the standard Velocity Loss and Baseline Prescribed Reps models. Of particular note is excellent performance in the Mean Average Error when RIR≤5, matching expert human estimators with years of experience coaching and resistance training. The Precision, Recall, and F1 columns are based on the binary classification task of correctly identifying when RIR≤5, i.e. identifying effective reps, which the advanced architecture model did effectively. The Velocity Loss model also demonstrated poor accuracy with the dataset because the main assumption that they are imparting maximum effort during every repetition they perform is usually not true.

The actions that may be taken with using the advanced architecture model to provide accurate, real-time RIR predictions comprise:

Identifying effective/stimulating reps dynamically during workouts;

Adjusting loads or rep targets mid-workout to hit muscle growth zones;

Tracking proximity to failure and fatigue levels across time; and/or

Personalizing rest and recovery guidance for smarter programming.

This provides a richer understanding of a given user's effort and the impacts of that effort, and allows the improvement to track progress and guide/coach users more effectively.

Figure 4:
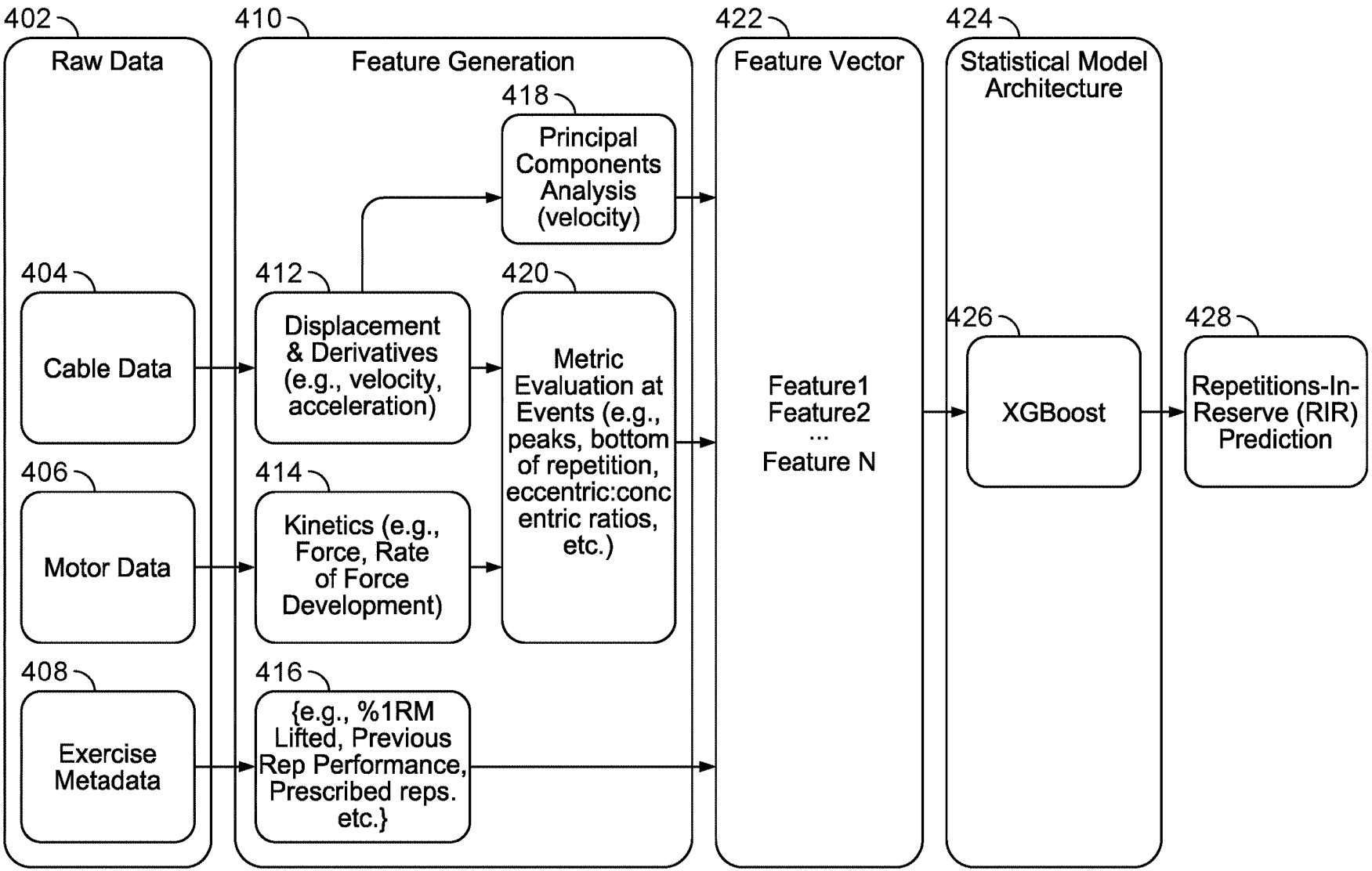
FIG. 4 is a block diagram illustrating an example of an advanced architecture model for estimating reps in reserve.

FIG. 4 is a block diagram illustrating an example of an advanced architecture model for estimating reps in reserve. In one embodiment, one or more processors (C102), memory (C110) as shown in FIG. 1C are configured to execute and/or be associated with the model in FIG. 4. In one embodiment, the processors and/or memory are remote to the system of FIG. 1A and/or FIG. 1B and coupled by network to the system of FIG. 1A and/or FIG. 1B via network interface (C116) of FIG. 1C. In one embodiment, a sensor in the motor (106) of FIG. 1A and/or a sensor in the cable (108) of FIG. 1A are configured to execute and/or be associated with the model in FIG. 4.

As shown in FIG. 4, raw data (402) is input, comprising various forms of raw data including cable data (404) from a position/velocity/acceleration sensor associated with the cable (108) of FIG. 1A, motor data (406) from a position/velocity/acceleration sensor associated with the motor (106) of FIG. 1A, and exercise metadata (408). Examples of exercise metadata (408) include set level context, user settings, environmental settings, and/or recovery status of the individual.

The raw data (402) is passed to feature generation (410). For example, cable data (404) is rendered as displacement and its derivatives such as velocity and/or acceleration (412). For example motor data (406) is rendered as kinetics (414) such as force, and/or rate of force development ("RFD"). Both the displacement/derivatives (412) and kinetics (414) may be further evaluated as metrics at events (420), for example evaluated peaks and/or the top of a rep, the bottom of the rep, and/or eccentric to concentric ratios. The displacement/derivatives (412) may also be further evaluated using principal components analysis (418), for example velocity over time. The exercise metadata (408) may be rendered as metadata-based features (416) such as % 1 RM lifted, previous rep performance, and/or prescribed reps using static analysis. Each of the generated features (410), (416), (418), (420) may then be assembled as a feature vector (422). The feature vector (422) is input to a statistical model architecture (424) such as LightGBM or XGBoost (426), which outputs an estimate of repetitions in reserve (428).

In one embodiment, the model is trained using aggregated performance data, for example the 56,025 bench press reps from 4,482 anonymous users with sampled position and velocity data at 50 hz during regular training sessions as described above. In one embodiment, the model is a decision tree, such as a gradient boosted tree. An example of feature importance, which is a count of how often each feature is used to 'split', or make a decision within the model after training is given in Table 3:

TABLE 3

Example Feature Importance for Advanced Architecture Model.

| Feature | Feature Importance Weighting (higher is more weighted) |
|---|---|
| Prescribed reps. The number of repetitions prescribed to the user to perform during an exercise set, based on a percentage of their estimated one repetition maximum strength. | 82 |
| Weight ratio. The ratio of the max load applied during the set and the suggested/prescribed weight for the set. | 57 |
| Rep ratio. The ratio of reps performed to the prescribed reps of the set (e.g., on rep 4 where the prescribed reps for the set was 8 represents 0.5) | 55 |
| Suggested weight. The weight an exercise machine system specifies for the user to lift for a given set based on the prescribed repetitions. | 53 |
| Minimum position. The minimum position of the actuator/barbell/dumbbell of a rep. | 46 |
| Maximum ROM. The range of motion of the entire repetition | 32 |
| Average weight. The average weight applied during the set for all potential weight modes. | 32 |
| PC3. The second principal component of the waveform/time series named PC3 in PCA. | 26 |
| Normalized average weight. The average weight of the set, normalized to the average value of the dataset. | 25 |
| Concentric duration. The time taken to complete the lifting portion of the repetition | 24 |

TABLE 3-continued

Example Feature Importance for Advanced Architecture Model.

| Feature | Feature Importance Weighting (higher is more weighted) |
|---|---|
| PC2. The second principal component of the waveform/time series named PC2 in PCA. | 22 |
| Inter rep rest duration. The time taken between completing the previous rep and starting the current rep. | 19 |
| PC1. The first principal component of the waveform/time series in PCA. | 18 |
| Speed at max concentric power. | 18 |
| Cable/actuator velocity at the frame associated with the maximum power during the lifting portion of the repetition. | |
| Concentric-eccentric speed ratio. The ratio of the average velocity of the lowering portion of the repetition relative to the lifting portion of the repetition. | 18 |
| Normalized maximum ROM. The range of motion of the rep, normalized to the group average. | 17 |
| PC4. The second principal component of the waveform/time series named PC4 in PCA. | 17 |
| Peak force ratio. The time taken between the start of the repetition and the moment of peak force output is divided by the time taken to complete the lifting portion of the repetition. | 17 |
| Eccentric speed ratio. The average velocity of the lifting portion of the repetition divided by the average velocity of the lowering portion of the repetition. | 17 |
| Avg speed. The average velocity of the lifting portion of the repetition. | 16 |
| Eccentric weight. The base weight on an exercise machine system during the lowering portion of the repetition. | 14 |

Sequential Models. In one embodiment, the statistical model (424) is a sequential model that incorporates features from more than one rep, for example the last three reps, the last reps in the current set, all reps performed today for the current movement, and/or the last reps performed by the user for yesterday and today across all movements.

For example, one sequential feature important to track may be the intra rest rep duration as each rep is performed. In one embodiment, XGBoost is extended as a model for sequential features. In one embodiment, a specific sequential model is used instead of XGBoost. In one embodiment, instead of Kernel, PCA is used for waveform/time-series analysis. In one embodiment, temporal convolutional networks are used to find patterns over time. In one embodiment, non-linear relationships are sought in the same manner that PCA finds linear relationships.

In one embodiment, different length data is incorporated into the model training and/or processing. For example, PCA of variable number of samples is accommodated even in the event the waveforms are of different length, and the analysis handles different numbers of samples per rep of displacement, velocity, and/or force data. For example, different sequencing of one rep, two reps, three reps, up to the number of reps in a set, are handled with variable lengths. In one embodiment, an extension of PCA is used at least in part for variable length data. In one embodiment, transformer architectures are used at least in part for variable length data, for example where waveforms are tokenized and a transformer associated with tokens of reps are input. In one embodiment, a variational autoencoder is used, for example to take data of different lengths and map it to a dictionary. For example, a sequence of a user's motion and/or rep data may be mapped to one of say 512 predefined motions, where the model learns off of predefined patterns and estimation involves classifying into the patterns.

Model Computation. In one embodiment, the model computation of FIG. 4 takes place in the exercise machine of FIG. 1A, 1B, and/or 2. In one embodiment, the model computation of FIG. 4 takes place in an external machine such as a server, using a network interface (C116) of FIG. 1C to couple it to the exercise machine of FIG. 1A, 1B, and/or 2. In one embodiment, the external machine is a mobile device such as a phone or tablet, and uses a network interface (C116) of FIG. 1C to couple it to the exercise machine of FIG. 1A, 1B, and/or 2. In one embodiment, model distillation is used to reduce the model for smaller computational resources, such as on a phone.

Applications of Model Estimation. In one embodiment, for example that shown in FIG. 4, an advanced model that uses whole time series data such as sensor data/metadata (402) in FIG. 4, for example a waveform (506) in FIG. 5, produces better output/estimation over a traditional, simpler linear regression based on one or more statistics of a waveform. In the example shown herein, the advanced model estimates reps in reserve and/or identifies an effective rep if the given rep is less than a threshold, say five, from RIR=0.

In one embodiment, the advanced model estimates volume during an exercise to help guide training. For example, volume calculations are typically derived as the product of the sets, reps, and load that someone lifts during a workout. One further application is to identify effective volume, referred herein as volume a user accumulates with effective reps, which are the reps that a user accumulates where their repetitions in reserve are below a given threshold. Given the cited importance of performing sets close to volitional failure to stimulate maximum muscle hypertrophy, identifying the total volume associated with those repetitions closer to failure may provide more sensitive detections of the muscular hypertrophy stimulus an exercise regime may induce. In contrast, for pure strength or power-related training objectives, a user may not want to accumulate as much "effective volume" given that repetitions performed too close to volitional failure may be counterproductive for those training adaptations. A report may indicate more relevant volume for a user trying to grow muscle, which would emphasize effective volume as well as total volume. Furthermore, a report may indicate the relevant volume for a user trying to improve their maximum strength or power. Programmatically workouts may be dynamically adjusted to favor adding difficulty and/or sets and/or movements to a workout that contribute towards increasing effective volume rather than simply total volume.

Put another way, with less than five reps left in a user's muscles, these five reps are effective reps for stimulating muscle growth. One implication is that for a user doing a twelve rep set and RIR is estimated to be twelve, the first seven reps are less effective than the last five reps. Similarly if a user is doing a twelve rep set and RIR is estimated to be fourteen, it would be only the last three reps that are effective.

Effective reps and RIR quantify how close a user is to failure, in part to understand what kind of stimuli is being posed for muscle hypertrophy. Another application is to better understand how taxing the user's workout is, in order to programmatically inform potential recovery models. For example, if a user has spent more time closer to failure for a movement just performed, the overall exercise regime may be dynamically changed to assume longer recovery time for the given muscle group associated with that movement just performed.

Another application is for a user who is training for strength and/or for power. In these cases a user may indicate to the system they do not want to be close to failure, and therefore the programmatic workout generator may dynamically change a set size to reduce effective reps or any reps that have a fatiguing effect and/or a deleterious effect on improving strength or power.

Another application is for a programmatic spotter mode, as described herein. For example, if the system indicates that a user is close to failure because of the identification of RIR and/or effective reps, the spotter mode may be more sensitive to intervene and/or be fed back to the spotter mode logic to improve the spotter mode. In one embodiment, spotter sensitivity is dynamically adjusted based at least in part on the estimate of repetitions in reserve output by the model. For example, a first user with 12 RIR may have a less sensitive spotter mode than a second user with 8 RIR who may themselves have a less sensitive spotter mode than a third user with 4 RIR.

Another application is for a suggested weights logic, wherein the suggested weights logic, that is the logic that suggests the most appropriate weight for a user given their goals and current capabilities, may be updated based on RIR estimations. For example, the intention of a set may be to perform 10 repetitions with a load that represents someone's 12-repetition maximum, that is, the load they can lift for a maximum of 12 repetitions. In other words, the intention of the set may be to perform 10 repetitions and complete the set with 2 repetitions in reserve. If a user is estimated to have more than 2 repetitions in reserve upon completion of the set, this may be a signal to increase the weight that is suggested to the user to impose the desired training stimulus for that exercise session. By contrast, if the user is detected to have 0 or 1 repetition in reserve, this may signal that even though the user could complete the set that the load may be too high for the desired training stimulus and it should be suggested to reduce it.

Another application is for a drop set mode, wherein within a set the drop set mode lowers a weight setting dynamically as a user fatigues at a current weight setting. An effective implementation of drop sets necessitates that the load is dynamically decreased before someone reaches volitional failure so that they can perform as many repetitions as possible with approximately 1-3 repetitions in reserve. Real-time estimation of RIR and/or effective reps improves the drop set mode by helping users stay in a zone of effective reps as the weight lowers with each repetition.

Another application is for a progressive weight mode, wherein the progressive weight mode tracks a given user's velocity and if: the user remains above a certain velocity in ratio to their own exhibited maximum weight, the mode increases the weight; if the user remains in a lower range of velocity in ratio to their own exhibited maximum weight, the mode maintains the current weight; and if the user goes below the range, the mode decreases the weight. Real-time estimation of RIR and/or effective reps improves the progressive weight mode by enhancing weight changes, for example if a user performs a change in weight and their RIR decreases rapidly, the weight is also decreased.

Another application is a muscle readiness technique enhancement. By obtaining more accurate estimates of the effective volume of a workout, the magnitude of the stimuli imposed during training may be identified and the dynamics of the muscle recovery cycle that would inform muscle readiness techniques be better modeled.

Figure 5:
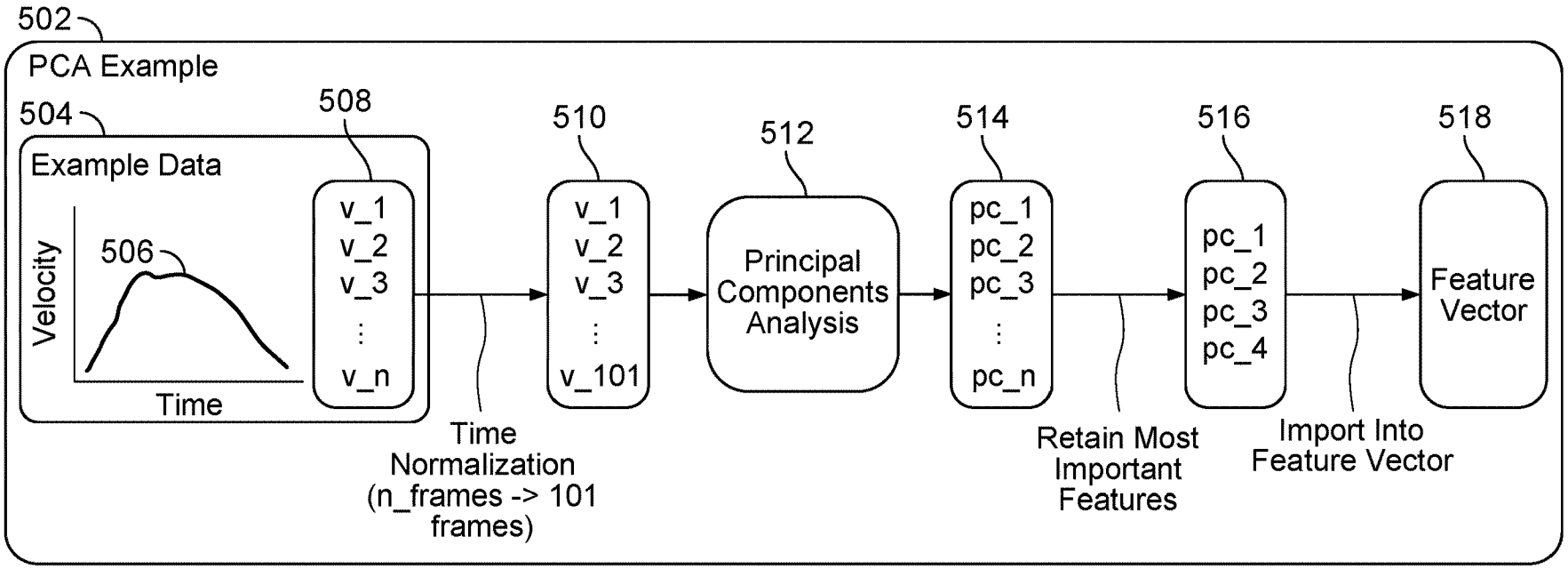
FIG. 5 is a flow diagram illustrating an example of a principal components analysis.

FIG. 5 is a flow diagram illustrating an example of a principal components analysis ("PCA.") In one embodiment, the PCA (502) in FIG. 5 is the PCA (418) shown in FIG. 4.

As shown in FIG. 5, sample data (504) includes a waveform shape, for example velocity of an actuator/cable/motor (506) for a user versus time. The waveform may be rendered as a time series (508) of velocity over n frames, which may then be time normalized into a static number of frames (510), for example 101 frames. The process of standardizing an arbitrary length of data into a fixed number of frames is referred herein as time normalization, and the subsequent data is referred herein as time normalized. The time normalized series (510) may be passed into the principal components analysis (512) to extract a set of principal components/features (514). PCA involves decomposing data into orthogonal components that capture maximal variance and is a traditional method of data dimensionality reduction and information compression. An example technique to perform the PCA is the PCA class from the Scikit-Learn Python library. From the set of principal components (514) the more important features are retained (516) or filtered through, based on a prior analysis, for example the one described in FIG. 3 with 56,025 reps of bench press. The important components/features are imported into the feature vector (518), for example the feature vector (422) in FIG. 4.

Figure 6:
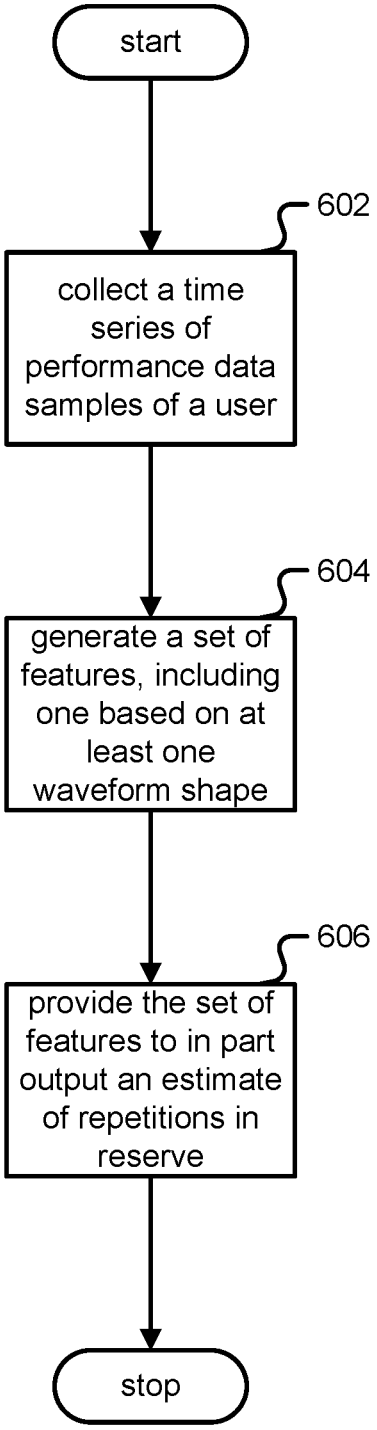
FIG. 6 is a flow diagram illustrating a process for improving reserve estimates during resistance training.

FIG. 6 is a flow diagram illustrating a process for improving reserve estimates during resistance training. In one embodiment, the flow of FIG. 6 is rendered by the system in FIG. 1A, FIG. 1B, FIG. 1C, and/or FIG. 2 and/or shown as a block diagram in FIG. 4.

In step (602), a time series of performance data samples of a user is collected. In one embodiment, from the sensor a time series of raw performance data samples is collected pertaining to a performing of a set of repetitions of a movement by a user. In one embodiment, the sensor is associated with an exercise machine, wherein the exercise machine further comprises a motor that provides exercise resistance to an actuator coupled to the motor via a cable. In one embodiment, torque requested of the motor is dynamically adjusted based at least in part on the estimate of repetitions in reserve output by the model. In one embodiment, the sensor senses the actuator position for an actuator that a user exercises against.

In step (604), a set of features is generated, including one based on at least one waveform shape. In one embodiment, from the collected time series of raw performance data samples a set of features is generated, including an extracting of one or more waveform shape features. In one embodiment, generating the set of features comprises generating the set of features according to a set of mappings. In one embodiment, the time series of raw performance data comprises a velocity waveform. In one embodiment, extracting the one or more waveform shape features includes analyzing the velocity waveform. In one embodiment, analyzing the velocity waveform comprises performing PCA. In one embodiment, the model is run locally at the exercise machine. In one embodiment, the model comprises a gradient-boosted tree model.

In step (606), the set of features is provided in part to output an estimate of reps in reserve. In one embodiment, the set of features is provided, including the extracted one or more waveform shape features, as input to a model that outputs an estimate of repetitions in reserve. In one embodiment, the output of the estimate of repetitions in reserve is done in real-time. In one embodiment, another output is identifying effective repetitions based at least in part on the estimate of repetitions in reserve output by the model. In one embodiment, identifying the effective repetitions comprises identifying when the estimated repetitions in reserve is below a threshold value, such as five. In one embodiment, spotter sensitivity is dynamically adjusted based at least in part on the estimate of repetitions in reserve output by the model. In one embodiment, effective volume is estimated based at least in part on the estimate of repetitions in reserve output by the model.

In one embodiment, the time series of raw performance data samples is updated at least in part by adding raw performance data samples pertaining to a current repetition to raw performance data samples pertaining to one or more prior repetitions; an updated set of features based at least in part on the updated time series of raw performance data samples pertaining to the current repetition and the one or more prior repetitions is generated; and the updated set of features is provided as input to the model, wherein the model outputs an updated estimate of repetitions in reserve. In one embodiment, the generated set of features includes an inter-repetition feature. In one embodiment, the inter-repetition feature comprises an inter-repetition rest duration.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a sensor;

a memory;

and one or more processors coupled to the memory and configured to:

collect, from the sensor, a time series of raw performance data samples pertaining to performing of a set of repetitions of a movement by a user, the time series of raw performance data comprises a velocity waveform;

generate, from the collected time series of raw performance data samples, a set of features, including extracting one or more waveform shape features, wherein extracting the one or more waveform shape features includes analyzing the velocity waveform and analyzing the velocity waveform comprises performing principal component analysis;

and provide the set of features, including the extracted one or more waveform shape features, as input to a model that outputs an estimate of repetitions in reserve;

wherein the one or more processors are further configured to dynamically adjust torque requested of a motor based at least in part on the estimate of repetitions in reserve output by the model.

2. The system of claim 1, wherein the motor provides exercise resistance to an actuator coupled to the motor via a cable.

3. The system of claim 1, wherein the sensor senses a position for an actuator that a user exercises against.

4. The system of claim 1, wherein generating the set of features comprises generating the set of features according to a set of mappings.

5. The system of claim 1, wherein the output of the estimate of repetitions in reserve is done in real-time.

6. The system of claim 1, wherein the one or more processors are further configured to identify effective repetitions based at least in part on the estimate of repetitions in reserve output by the model.

7. The system of claim 1, wherein: the one or more processors are further configured to identify effective repetitions based at least in part on the estimate of repetitions in reserve output by the model; and identifying the effective repetitions comprises identifying when the estimated repetitions in reserve is below a threshold value.

8. The system of claim 1, wherein the one or more processors are further configured to dynamically adjust spotter sensitivity based at least in part on the estimate of repetitions in reserve output by the model.

9. The system of claim 1, wherein the one or more processors are further configured to: update the time series of raw performance data samples at least in part by adding raw performance data samples pertaining to a current repetition to raw performance data samples pertaining to one or more prior repetitions; generate an updated set of features based at least in part on the updated time series of raw performance data samples pertaining to the current repetition and the one or more prior repetitions; and provide the updated set of features as input to the model, wherein the model outputs an updated estimate of repetitions in reserve.

10. The system of claim 1, wherein the model is run locally at the exercise machine.

11. The system of claim 1, wherein the model comprises a gradient-boosted tree model.

12. The system of claim 1, wherein the generated set of features includes an inter-repetition feature.

13. The system of claim 1, wherein the inter-repetition feature comprises an inter-repetition rest duration.

14. The system of claim 1, wherein the one or more processors are further configured to estimate effective volume based at least in part on the estimate of repetitions in reserve output by the model.

15. A method, comprising:

collecting, from a sensor, a time series of raw performance data samples pertaining to performing of a set of repetitions of a movement by a user, wherein the time series of raw performance data comprises a velocity waveform;

generating, from the collected time series of raw performance data samples, a set of features, including extracting one or more waveform shape features, wherein extracting the one or more waveform shape features includes analyzing the velocity waveform; and analyzing the velocity waveform comprises performing principal component analysis;

and providing the set of features, including the extracted one or more waveform shape features, as input to a model that outputs an estimate of repetitions in reserve;

wherein torque requested of a motor coupled to a user actuator is dynamically adjusted based at least in part on the estimate of repetitions in reserve output by the model.

16. A computer program product, the computer program product being embodied in a tangible non-transitory computer readable storage medium and comprising computer instructions for:

collecting, from a sensor, a time series of raw performance data samples pertaining to performing of a set of repetitions of a movement by a user, wherein the time series of raw performance data comprises a velocity waveform;

generating, from the collected time series of raw performance data samples, a set of features, including extracting one or more waveform shape features, wherein extracting the one or more waveform shape features includes analyzing the velocity waveform and analyzing the velocity waveform comprises performing principal component analysis;

and providing the set of features, including the extracted one or more waveform shape features, as input to a model that outputs an estimate of repetitions in reserve;

wherein torque requested of a motor coupled to a user actuator is dynamically adjusted based at least in part on the estimate of repetitions in reserve output by the model.

* * * * *